US007243498B2

(12) United States Patent
Sone et al.

(10) Patent No.: US 7,243,498 B2
(45) Date of Patent: Jul. 17, 2007

(54) FIN STRUCTURE

(75) Inventors: Kazuya Sone, Niigata-ken (JP); Kazuo Maezawa, Niigata-ken (JP)

(73) Assignee: Twinbird Corporation (JP)

( * ) Notice: Subject to any disclaimer, the term of this patent is extended or adjusted under 35 U.S.C. 154(b) by 379 days.

(21) Appl. No.: 10/995,786

(22) Filed: Nov. 23, 2004

(65) Prior Publication Data

US 2005/0120722 A1 Jun. 9, 2005

(30) Foreign Application Priority Data

Dec. 3, 2003 (JP) ..... 2003-404735

(51) Int. Cl.
*F25B 9/00* (2006.01)
*F28D 7/10* (2006.01)

(52) U.S. Cl. ..... 62/6; 165/154

(58) Field of Classification Search ..... 62/6; 165/154

See application file for complete search history.

(56) References Cited

U.S. PATENT DOCUMENTS 2,260,594 A * 10/1941 Young ..... 165/125
2,756,032 A * 7/1956 Dowell ..... 165/121
2,784,570 A * 3/1957 Kohler ..... 62/6
5,339,640 A * 8/1994 Reinke ..... 62/6
6,161,389 A * 12/2000 Sekiya et al. ..... 62/6
6,422,025 B1 * 7/2002 Rudick et al. ..... 62/6
6,675,588 B2 * 1/2004 Rudick ..... 62/6
6,715,285 B2 * 4/2004 Isaac, Jr. ..... 60/520
6,931,863 B2 * 8/2005 Chen et al. ..... 62/6
7,104,073 B2 * 9/2006 Chen et al. ..... 62/6

FOREIGN PATENT DOCUMENTS

JP 2002-062021 2/2002

* cited by examiner

*Primary Examiner*—William C Doerrler
(74) *Attorney, Agent, or Firm*—Akerman Senterfitt

(57) ABSTRACT

A fin structure for heat-exchanging, the fin structure being mounted on a heat-dissipating portion of a Stirling cycle cooler, wherein the fin structure is configured by coupling a plurality of unit structures, the plurality of unit structures being split by a plurality of surfaces extending from a inner circumference of the fin structure toward an outer circumference thereof. The fin structure is configured thus way, whereby it can be mounted on the heat-dissipating portion so as to sandwich the heat-dissipating portion from the outer circumference thereof by the plurality of unit structures coupled one another. Accordingly, when mounting the fin structure, large force is not required, no adhesive filler is applied to an unneeded portion of the Stirling cycle cooler, and generating a scratch or a distortion on the casing of the Stirling cycle cooler can be prevented.

4 Claims, 5 Drawing Sheets

(a)

FIN STRUCTURE

BACKGROUND OF THE INVENTION

1. Field of the Invention

The present invention relates to a fin structure for heat-exchanging which is mounted on an heat dissipating or absorbing portion of a Stirling cycle cooler.

2. Description of the Related Art

Recently, a refrigerating container using a Stirling cycle cooler has been extensively used as a CFC (chlorofluorocarbon) substitute refrigerating apparatus. The Stirling cycle cooler is a closed cycle engine which absorbs and dissipates heat by expanding and compressing a working gas with a piston driven by an external power and a displacer reciprocated at a predetermined phase difference relative to the piston, and repeating these processes. A cooling portion thereof is thermally connected to the refrigerating container via a heat-exchanger for heat-absorbing, while a cooling of the refrigerating container is carried out by this heat-exchanger. In a heat-dissipating portion of the Stirling cycle cooler, since an interior thereof is brought into a high-temperature state, a fin structure as a heat-exchanger for heat-dissipating portion is mounted on an outer circumference of the heat-dissipating portion. By sending air to the fin structure, the temperature of the heat-dissipating portion is lowered.

For instance, Japanese Unexamined Patent Publication No. 2002-62021 discloses a conventional fin assembly. As shown in FIG. 5, the conventional fin structure 101 is mounted on the Stirling cycle cooler 100. The fin structure 101 has fins 103 provided on an outer circumference of an annular holding rim 102, wherein the fins 103 are formed by folding a plate material of a predetermined length perpendicularly relative to a longitudinal axial line thereof at essentially equal intervals, while the fin structure 101 is formed in an annular shape as a whole. The Stirling cycle cooler 100 is inserted into the fin structure 101 along a central axis thereof to reach a heat-dissipating portion 104, whereby the fin structure 101 is mounted on the Stirling cycle cooler 100. Meanwhile, the holding rim 102 of the fin structure 101 is thermally bonded to the heat-dissipating portion 104 of the Stirling cycle cooler 100 with a thermally conductive adhesive, filler, solder, or the like.

The fin structure 101, however, has problems that, when inserting the Stirling cycle cooler 100, the thermally conductive adhesive, filler or the like adheres to an upper portion of the Stirling cycle cooler 100, so that the upper portion becomes dirty, and the applied condition of the thermally conductive adhesive or the like in an inner circumference of the holding rim 102 becomes non-uniform due to adhesion of the thermally conductive adhesive or the like on the upper portion of the Stirling cycle cooler 100. Moreover, in the case that the fin structure 101 is pressed into the Stirling cycle cooler 100 by pushing it from the above of the Stirling cycle cooler 100, considerable force is necessary, and thus mounting the fin structure 101 is not easy. In addition, a casing of the Stirling cycle cooler 100 may be scratched and distorted when pressing the fin structure 101, and in the worst case, the casing may be broken due to an excessive external force applied thereto. Further, in the case that the fin structure 101 is fixed to the Stirling cycle cooler 100 by the solder or the like, the casing may be distorted since the casing is partially brought into a high-temperature state due to the melting of the solder or the like.

SUMMARY OF THE INVENTION

The present invention has been made to solve the above problems, it is, accordingly, an object of the present invention to provide a fin structure which can prevent a thermally conductive adhesive, filler or the like from adhering to a portion of a Stirling cycle cooler where they are unneeded and a casing from being scratched or distorted, and enables easy mounting on the Stirling cycle cooler.

In order to attain the above object, according to a first aspect of the present invention, there is provided a fin structure for heat-exchanging, the fin structure being mounted on a heat dissipating or absorbing portion of a Stirling cycle cooler, wherein the fin structure is configured by coupling a plurality of unit structures, the unit structures being split by a plurality of surfaces extending from an inner circumference of the fin structure toward an outer circumference thereof.

According to the first aspect, the fin structure can be mounted on a heat-dissipating or heat-absorbing portion of the Stirling cycle cooler by arranging each of the plurality of the unit structures around the heat-dissipating or heat-absorbing portion of the Stirling cycle cooler and coupling the plurality of the unit structures. Accordingly, inserting the Stirling cycle cooler into the fin structure is not necessary when mounting the fin structure on the heat-dissipating or heat-absorbing portion, but the fin structure can be mounted on the outer circumference thereof. Moreover, a heat-conductive adhesive or filler is applied to an inner circumference of each unit structure, and then each unit structure is moved from the outside of the heat-dissipating or heat-absorbing portion toward them so as to be arranged around the outer circumference, whereby no adhesive or filler is applied to a portion of the Stirling cycle cooler where such adhesive or filler is unneeded when mounting. Further, the above-mentioned fin structure ensures one to check whether the adhesive or the like is spread enough between the inner surface of the fin structure and the outer circumference of the heat-dissipating or heat-absorbing portion or not. Still further, since pressing the Stirling cycle cooler into the fin structure is not necessary, a scratch or a distortion on the casing of the Stirling cycle cooler can be prevented.

Alternatively, in the above fin structure, each unit structure may be formed with an opposed portion, and the unit structures may be mounted on the heat-dissipating or heat-absorbing portion of the Stirling cycle cooler by coupling adjoining unit structures using coupling members, each coupling member being inserted in two of the unit structures adjoining with each other so as to pinch the opposed portions thereof.

Moreover, each unit structure may comprise: an inner rim formed in a shape matching a contour of the outer circumference of the Stirling cycle cooler, the inner rim contacting the outer circumference thereof; an outer rim provided outwardly relative to the inner rim; an intermediate rim provided between the inner rim and the outer rim, the intermediate rim being connected with the inner rim via the opposed portions; a plurality of fins provided between the inner rim and the intermediate rim; and a plurality of fins provided between the intermediate rim and the outer rim.

The above-described inner rims may contact the outer circumference of the Stirling cycle cooler via a heat-conductive filler, the heat-conductive filler being applied to each inner rim of the plurality of unit structures.

Further, in the above-described fin structure, a portion of each opposed portion may be formed with a first screw hole, the portion being adjacent to the intermediate rim; each coupling member may be formed with a second screw hole; and each coupling member may be fixed by inserting a screw in the first and second screw holes.

Still further, each unit structure may comprise: an inner rim formed in a shape matching a contour of the outer circumference of the Stirling cycle cooler, the inner rim contacting the outer circumference thereof; an outer rim provided outwardly relative to the inner rim; an intermediate rim provided between the inner rim and the outer rim; a plurality of fins provided between the inner rim and the intermediate rim, a part of the fins forming the opposed portions; and a plurality of fins provided between the intermediate rim and the outer rim.

BRIEF DESCRIPTION OF THE DRAWINGS

These objects, other objects and advantages of the present invention will become more apparent upon reading of the following detailed description and the accompanying drawings in which.

DETAILED DESCRIPTION OF THE PREFERRED EMBODIMENTS

Preferred embodiments of the present invention will now be described in detail with reference to the accompanying drawings. In the preferred embodiments, a portable refrigerating container will be taken as an example of one which employs a fin structure of the invention, but it is not limited to a portable refrigerating container but an installing type refrigerating container, for instance, may employ the fin structure.

Figure 1:
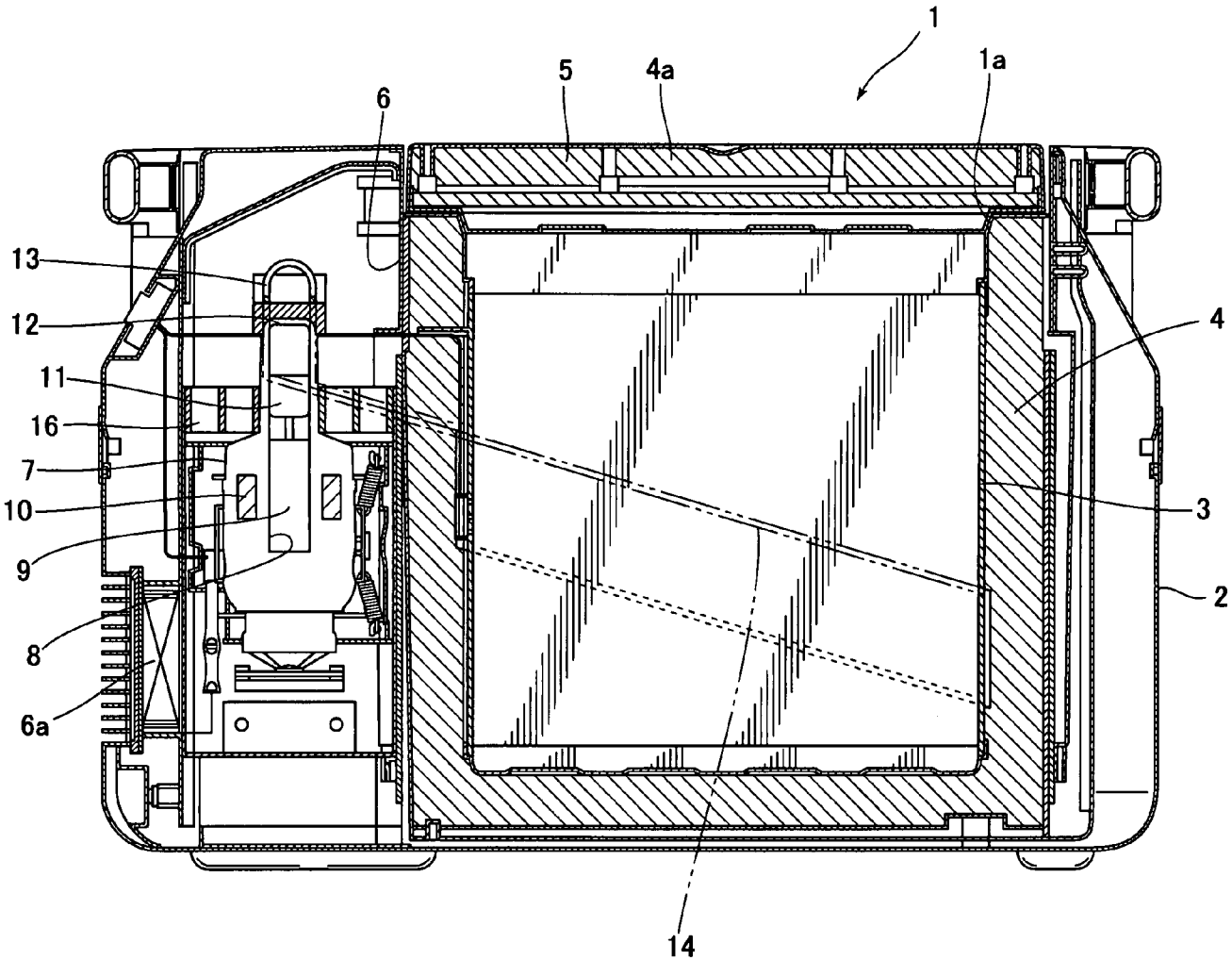
FIG. 1 is a schematic cross sectional view showing a refrigerating container which employs a fin structure according to a preferred embodiment of the present invention.

A refrigerating container which employs the fin structure of this embodiment will now be described with reference to FIG. 1. In this figure, reference number 1 denotes a portable refrigerating container. The refrigerating container 1 comprises: an outer casing 2; an inner container 3 provided in the inside of the outer casing 2 and made from a material having good thermal conductance such as aluminum or the like; and a thermal insulator 4 provided in between the outer casing 2 and the inner container 3. An upper portion of the refrigerating container 1 is formed with an opening 1*a*, while a cover 5 having the thermal insulator 4*a* thereinside is provided over the opening 1*a* so as to freely open and close the opening 1*a*.

A compartment 6 is defined at a side of the inner container 3 provided in the inside of the outer casing 2. A Stirling cycle cooler 7 for cooling the inside of the inner container 3 is installed in the compartment 6. As disclosed in, for instance, Japanese Unexamined Patent Publication No. 2000-337725, the Stirling cycle cooler 7 comprises: a piston 9 capable of reciprocating in the inside of a cylinder 8; a driving mechanism 10 for reciprocating the piston 9 along an axial direction of the cylinder 8; and a displacer 11 reciprocating along the axial direction while following the reciprocation of the piston 9. The Stirling cycle cooler 7 is juxtaposed to the inner container 3 and stands perpendicularly so that the piston 9 and the displacer 11 can be in perpendicular.

A distal end portion of the Stirling cycle cooler 7 is a cooling portion 12 where heat is absorbed by a reversed Stirling cycle, while a heat conduction block 13, which is made of a material having good heat conductance such as aluminum, is provided on the cooling portion 12. A refrigerant-filled heat pipe 14 is thermally connected to the heat conduction block 13. The heat pipe 14 extends to the outer circumference of the inner container 3 from the heat conduction block 13, goes around that outer circumference, and returns to the heat conduction block 13, whereby the heat pipe 14 is arranged so as to absorb heat of the inner container 3 as well as heat of the inside thereof.

A heat-dissipating portion 15 is provided below the distal end portion of the Stirling cycle cooler 7, wherein the heat-dissipating portion 15 is to be brought into a high-temperature state by the compression of a working gas in the reversed Stirling cycle. A fin structure 16 for heat-exchanging (in this case, heat-dissipating) is provided on the outer circumference of the heat-dissipating portion 15 so as to decrease a temperature of the heat-dissipating portion 15. An airflow is generated by rotating a fan 6*a* provided at a sidewall of the compartment 6, so that heated air around the fin structure 16 is exhausted to the outside of the compartment 6 and air of relatively low temperature is introduced to the circumference of the fin structure 16, thereby decreasing the temperature of the heat-dissipating portion 15.

Figure 2:
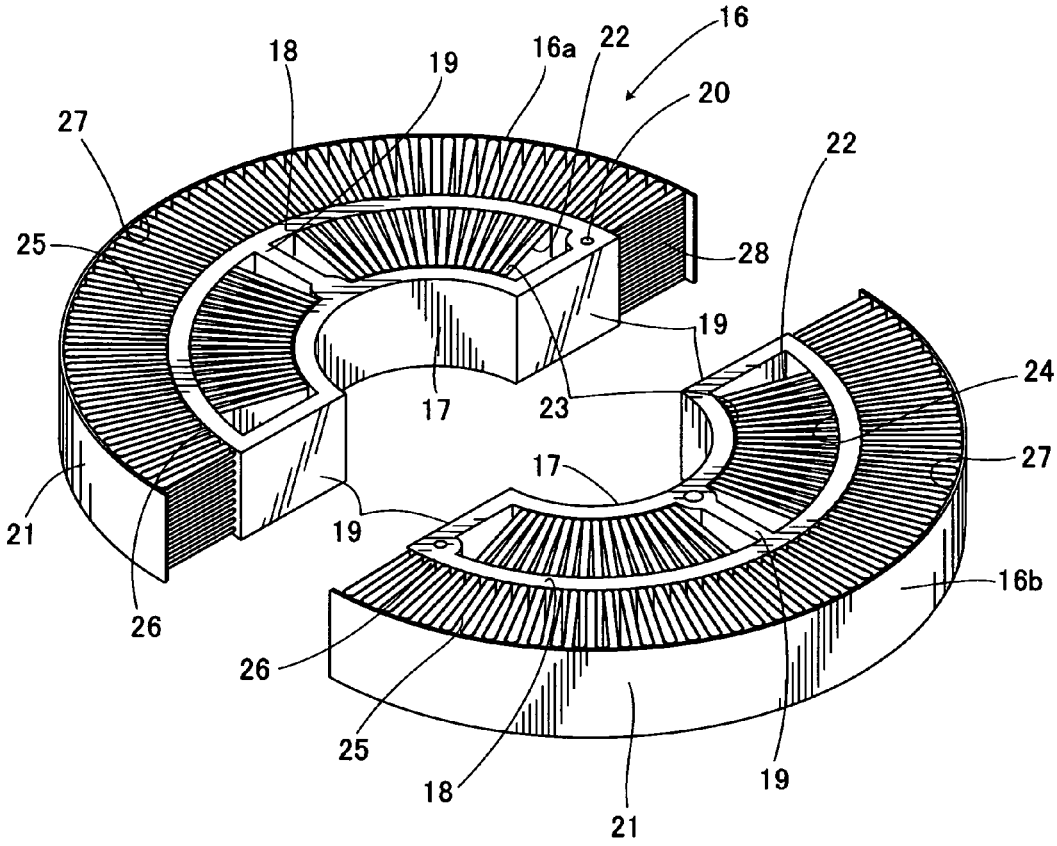
FIG. 2 is a schematic perspective view showing the fin structure according to the preferred embodiment.

FIG. 2 is an exploded perspective view showing the fin structure 16. As illustrated, the fin structure 16 comprises a pair of unit structures 16*a*, 16*b* that are two pieces divided along a central axis thereof. Each of the unit structures 16*a*, 16*b* has: an inner rim 17 formed in a semi-circular arc shape essentially matching an outer shape of the heat-dissipating portion 15; and an intermediate rim 18 formed in a semi-circular arc shape and provided outwardly relative to the inner rim 17 so that it is apart from the inner rim 17. Coupling walls 19 radiating toward the intermediate rim 18 from both ends and a central portion of each inner rim 17 are provided. The coupling walls 19 allow the inner and intermediate rims 17, 18 to be integral and coaxial. Among the coupling walls 19 connecting the inner and intermediate rims 17, 18, ones are formed with screw holes 20 respectively on portions thereof adjacent to the intermediate rim 18. An outer rim 21 formed in a semi-circular arc shape is arranged outwardly relative to the intermediate rim 18 in a similar way as the inner and intermediate rims 17, 18. Inner fins 22, which are formed by bending a plate material of a predetermined length perpendicularly relative to a longitudinal axis of the plate material at predetermined intervals, are fixed in between the inner and intermediate rims 17, 18 by brazing folds-groups 23 to an outer circumference of the inner rim 17 and folds-group 24 to an inner circumference of the intermediate rim 18. Moreover, outer fins 25, which are formed by bending a plate material of a predetermined length perpendicularly relative to a longitudinal axis of the plate material at predetermined intervals in a similar way as the inner fins 22, are fixed in between the intermediate and outer rims 18, 21 by brazing folds-group 26 to an outer circumference of the intermediate rim 18 and folds-group 27 to an inner circumference of the outer rim 21. The outer rim 21 is arranged coaxial relative to the inner and intermediate rims 17, 18 by the outer fins 25. A plurality of incisions 28 are formed on each of fins 22, 25 along the longitudinal direction thereof so as to enhance heat-dissipating effects. In this embodiment, the fin structure 16 is made of light-weight aluminum of good heat conductivity, but the material thereof is not limited to this. For instance, the fin structure 16 may be made of other material of good heat conductivity such as copper.

Figure 3:
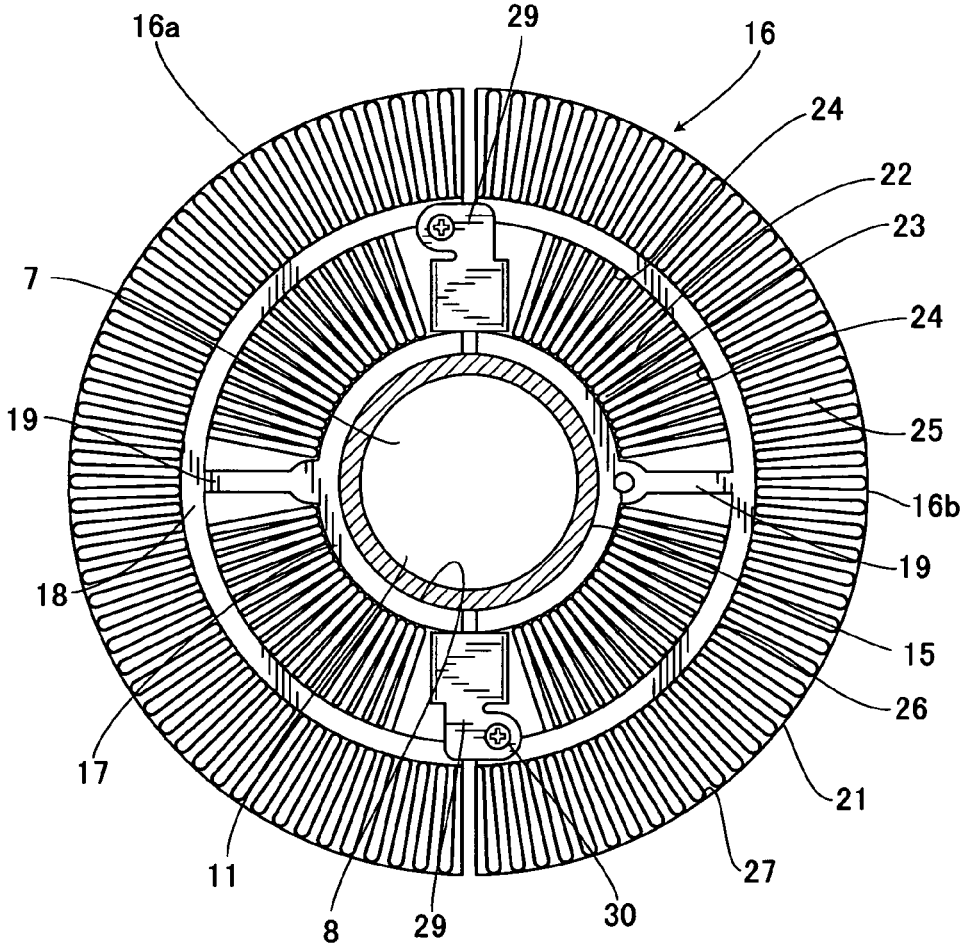
FIG. 3 is a top view showing a condition that the fin structure of the preferred embodiment is mounted on a Stirling cycle cooler.
Figure 4A:
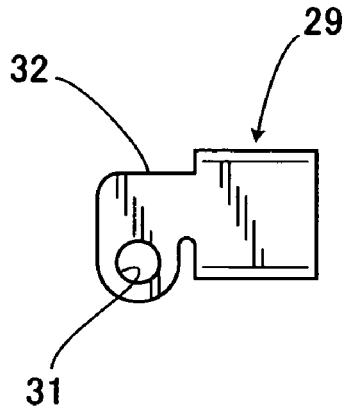
FIG. 4A is a top view showing a clip for mounting the fin structure.
Figure 4B:
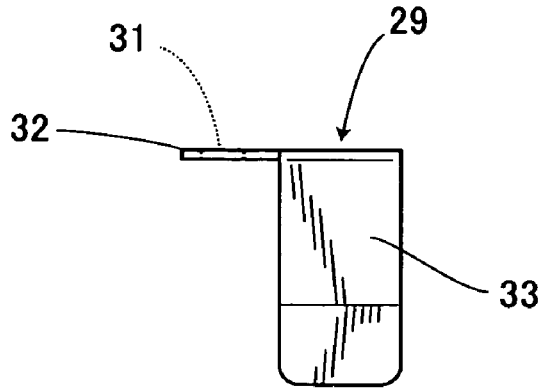
FIG. 4B is a front view thereof.
Figure 4C:
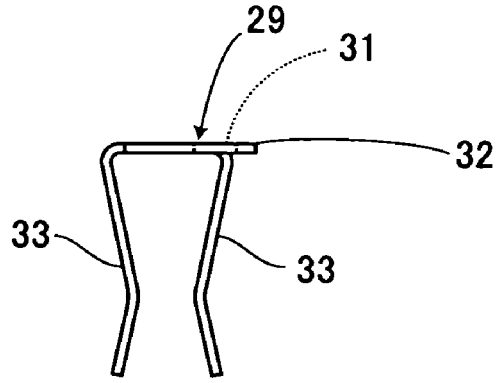
FIG. 4C is a side view thereof.
Figure 5:
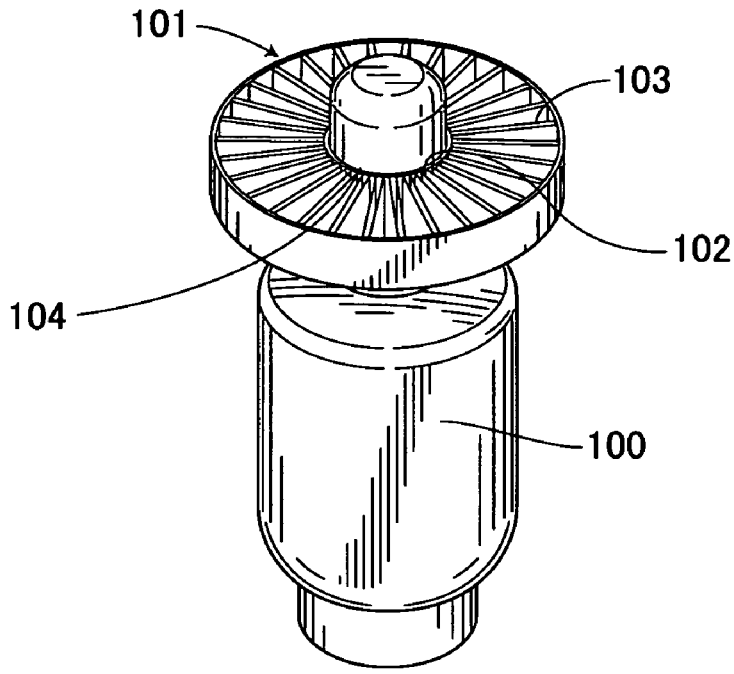
FIG. 5 (PRIOR ART)
FIG. 5 is a schematic perspective view showing a conventional fin structure.

FIG. 3 is a top view showing a condition that the fin structure 16 is mounted on an outer circumference of the Stirling cycle cooler 7. In this condition, the fin structure 16 is arranged around the heat-dissipating portion 15 of the Stirling cycle cooler 7 so as to allow each of the coupling walls 19 of the unit structures 16*a*, 16*b* to face with each other. Clips 29 (coupling member) are inserted so that each clip 29 pinches the coupling walls 19 facing with each other. Each screw 30 holds the clip 29 so as to pinch one of the coupling walls 19 of the unit structure 16*a* and one of the coupling walls 19 of the unit structure 16*b*, two of those coupling walls 19 facing with each other. FIGS. 4 are figures showing one of the clip 29 viewed from three directions, FIG. 4A is a top view, FIG. 4B is a front view and FIG. 4C is a side view. The clip 29 is formed by punching out a piece from a sheet of plate material with a pressing machine or the like, and folding the punched out piece. The clip 29 has a back portion 32 formed with a screw hole 31 and a pair of tips 33. A gap between the pair of tips 33 narrows toward the downward thereof, and then opens wide toward the ends thereof from the middle thereof. Accordingly, when the clip 29 is inserted, the coupling walls 19 is introduced between the pair of tips 33 in a bottom portion of the tips 33 (a portion whose gap opens wide toward the downward), while the walls 19 are pinched by the pair of tips 33 due to an elastic force of the clip 29 in a portion between the middle of the tips 33 and the upper thereof (a portion whose gap narrows toward the downward). In this embodiment, each clip 29 is made of stainless steel, but it may be made of other materials.

Next, how to mount the fin structure 16 will now be explained in detail. First, a silicon-based adhesive filler is applied to an inner circumference of the inner rim 17 of each of the unit structures 16*a*, 16*b*. Meanwhile, one applied to the inner rim 17 is not limited to this, others such as an adhesive of high-heat conductivity, heat conductive adhesive sheet may be applied. Moreover, it is preferable that one applied to the inner rim 17 have adhesiveness, viscosity, deposition property or the like so as to support the fin structure 16, but a filler such as silicon-grease may be applied as long as a pinching force by the clip 29 is sufficient. Further, the adhesive filler or the like may be applied to the heat-dissipating portion 15, instead of the inner frame 17. The unit structures 16*a*, 16*b* are arranged so as to sandwich the heat-dissipating portion 15 of the Stirling cycle cooler 7. When arranging, the inner circumferences of the inner rims 17 of the respective unit structures 16*a*, 16*b* contact the heat-dissipating portion 15 of the Stirling cycle cooler 7 via the applied adhesive filler. Since a clearance between the heat-dissipating portion 15 and each inner rim 17 is filled with the adhesive filler, a heat-conduction from the heat-dissipating portion 15 to the fin structure 16 can be carried out effectively. The clips 29 are inserted so that tips 33 thereof can pinch the coupling walls 19 facing with each other and formed on both ends of the unit structures 16*a*, 16*b*. In order to prevent the clips 29 from coming off from the fin structure 16 due to a vibration of the Stirling cycle cooler 7, each clip 29 is fixed to the fin structure 16 by putting the screws 30 in the screw holes 20 of the fin structure 16 via the screw holes 31 of the clips 29. Accordingly, the pair of unit structures 16*a*, 16*b* is held by the clips 29, thus holding the heat-dissipating portion 15 of the Stirling cycle cooler 7 by the inner rims 17 of the fin structure 16, thereby fixing the fin structure 16 to the heat-dissipating portion 15. Meanwhile, since the pinching forces by the clips 29 are not so large, a casing of the Stirling cycle cooler 7 is not distorted even if the heat-dissipating portion 15 is tightened by the fin structure 16 with the clips 29 inserting. Moreover, since the fin structure 16 is fixed to the heat-dissipating portion 15 by the adhesive filler in addition to the pinching forces by the clips 29, it can be fixed to the heat-dissipating portion 15 with a sufficient strength due to the combination of the pinching forces by the clips 29 with an adhesive force of the adhesive filler even if the pinching forces are not so large. In contrast, even if the adhesive force is not so large, the fin structure 16 can be fixed to the heat-dissipating portion 15 with a sufficient strength due to the combination of the adhesive force with the pinching forces by the clips 29. Accordingly, one applied between the heat-dissipating portion 15 and the inner rims 17 can be selected by emphasizing not the adhesive force or the like, but heat-conductivity.

As explained above, according to this embodiment, the pair of unit structures 16*a*, 16*b* having inner circumferences coated with the adhesive fillers are arranged around the heat-dissipating portion 15 so as to sandwich the heat-dissipating portion 15, each of the clips 29 is inserted so as to pinch the pair of coupling walls 19 of the unit structures 16*a*, 16*b* facing with each other, whereby the fin structure 16 can be mounted on the outer circumference of the heat-dissipating portion 15. Accordingly, pressing the Stirling cycle cooler 7 into the fin structure 16 is not necessary when mounting, and thus large force is not required, while a scratch or a distortion on the casing of the Stirling cycle cooler can be prevented. Moreover, no adhesive filler is applied to an undesirable portion of the Stirling cycle cooler 7 when mounting the fin structure 16 on the heat-dissipating portion 15 because the unit structures 16*a*, 16*b* are moved toward the heat-dissipating portion 15 from the outside thereof along directions perpendicular to an axial direction of the heat-dissipating portion 15 so as to arrange the unit structures 16*a*, 16*b* on the outer circumference of the heat-dissipating portion 15 after the adhesive filler is applied to the inner circumferences of the inner rims 17. Further, since uniformity of the adhesive filler applied to the inner circumferences of the inner rims 17 can be assured, the clearance between the heat-dissipating portion 15 and the unit structures 16*a*, 16*b* can be surely filled with the adhesive filler. Still further, since each clip 29 employs a simple structure, it can be easily produced. Yet further, the fin structure 16 can be mounted on the heat-dissipating portion 15 of the Stirling cycle cooler 7 by inserting the clips 29 so as to pinch the coupling walls 19 of the unit structures 16*a*, 16*b*, and thus mounting the fin structure 16 is not difficult.

The present invention is not limited to the above embodiment, various embodiments and changes may be made thereonto without departing from the broad spirit and scope of the invention. For instance, whilst the fin structure is formed circular in shape, but it may be formed into a shape conforming to that of the heat-dissipating portion in the case that the heat-dissipating portion is formed into a different shape from that of the above embodiment. Moreover, in the above embodiment, the fins are formed by bending a sheet of plate material back and forth at equal intervals, but the fins are not limited to this. For instance, the fins may be one comprising a plurality of projections. Further, in the above embodiment, the coupling walls for coupling the inner and intermediate rims are arranged as opposed surfaces, while the clips as the coupling members are inserted so as to pinch these opposed surfaces, but the opposed surfaces are not limited to this structure. For instance, the fins on both ends of the unit structures may be used as the opposed surfaces by forming them in thick. Still further, in the above embodiment, the fin structure is formed by coupling the pair of unit structures with the clips (coupling members) inserted, that is, the fin structure is formed of two of the unit structures, but the fin structure may be formed by coupling three or more unit structures with the coupling members. Moreover, whilst the fin structure is mounted on the heat-dissipating portion of the Stirling cycle cooler, but it may be mounted on a heat-absorbing portion thereof.

What is claimed is:

1. A fin structure for heat-exchanging, said fin structure being mounted on a portion of a Stirling cycle cooler, wherein said fin structure is configured by coupling a plurality of unit structures, said plurality of unit structures being split by a plurality of surfaces extending from an inner circumference of said fin structure toward an outer circumference thereof, wherein each unit structure is formed with an opposed portion, wherein said unit structures are mounted on a Stirling cycle cooler by coupling members, each coupling member being inserted in two of said unit structures adjoining with each other so as to pinch said opposed portions, wherein each unit structure comprises:

an inner rim formed in a shape matching a contour of the outer circumference of the Stirling cycle cooler, said inner rim contacting the outer circumference thereof;

an outer rim provided outwardly relative to said inner rim; an intermediate rim provided between said inner rim and said outer rim, said intermediate rim being connected with said inner rim via said opposed portions;

a plurality of fins provided between said inner rim and said intermediate rim; and a plurality of fins provided between said intermediate rim and said outer rim.

2. The fin structure according to claim 1, wherein said inner rims contact the outer circumference of the Stirling cycle cooler via a heat-conductive filler, said heat-conductive filler being applied to each inner rim of said plurality of unit structures.

3. The fin structure according to claim 2, wherein:

a portion of each opposed portion is formed with a first screw hole, said portion being adjacent to said intermediate rim;

each coupling member is formed with a second screw hole; and each coupling member is fixed by inserting a screw in the first and second screw holes.

4. A fin structure for heat-exchanging, said fin structure being mounted on a portion of a Stirling cycle cooler, wherein said fin structure is configured by coupling a plurality of unit structures, said plurality of unit structures being split by a plurality of surfaces extending from an inner circumference of said fin structure toward an outer circumference thereof;

each unit structure is formed with an opposed portion;

said unit structures are mounted on a Stirling cycle cooler by coupling members, each coupling member being inserted in two of said unit structures adjoining with each other so as to pinch said opposed portions;

wherein each unit structure comprises:

an inner rim formed in a shape matching a contour of the outer circumference of the Stirling cycle cooler, said inner rim contacting the outer circumference thereof;

an outer rim provided outwardly relative to said inner rim; an intermediate rim provided between said inner rim and said outer rim;

a plurality of fins provided between said inner rim and said intermediate rim, portions of said plurality of fins forming said opposed portions; and a plurality of fins provided between said intermediate rim and said outer rim.

* * * * *